US007556180B1

(12) United States Patent
Hansen et al.

(10) Patent No.: US 7,556,180 B1
(45) Date of Patent: Jul. 7, 2009

(54) GARMENT HANGER HAVING CLAMP ASSEMBLIES

(75) Inventors: James Hansen, Coopersville, MI (US); Russell O. Blanchard, Zeeland, MI (US); Kin Chiu Chung, Dongguan (CN)

(73) Assignee: Hanger Plus, LLC, Cooperville, MI (US)

( * ) Notice: Subject to any disclaimer, the term of this patent is extended or adjusted under 35 U.S.C. 154(b) by 0 days.

(21) Appl. No.: 11/820,492

(22) Filed: Jun. 19, 2007

Related U.S. Application Data

(63) Continuation-in-part of application No. 11/509,838, filed on Aug. 24, 2006.

(51) Int. Cl.
*A41D 27/22* (2006.01)

(52) U.S. Cl. ..... 223/96; 223/85; 223/95

(58) Field of Classification Search ..... 223/85, 223/88, 90, 91, 93, 95, 96, DIG. 2
See application file for complete search history.

(56) References Cited

U.S. PATENT DOCUMENTS

| | | | |
|---|---|---|---|
| 4,192,441 | A | 3/1980 | Batts |
| 4,231,500 | A | 11/1980 | Mainetti |
| 4,395,799 | A | 8/1983 | Batts |
| D271,649 | S | 12/1983 | Batts et al. |
| 4,446,996 | A | 5/1984 | Garrison |
| 4,638,930 | A | 1/1987 | Blanchard |
| 4,660,750 | A | 4/1987 | Blanchard |
| D296,729 | S | 7/1988 | Blanchard |
| D297,286 | S | 8/1988 | Blanchard |
| D301,808 | S | 1/1989 | Marshall |
| D301,661 | S | 6/1989 | Wilson |
| D301,943 | S | 7/1989 | Wilson |
| D328,194 | S | 7/1992 | Garrison |
| 5,183,191 | A | 2/1993 | Garrison et al. |
| D334,846 | S | 4/1993 | Blanchard |
| 5,212,854 | A | 5/1993 | Hollis |
| D337,893 | S | 8/1993 | Norman |

(Continued)

FOREIGN PATENT DOCUMENTS

| | | | |
|---|---|---|---|
| JP | 05103899 | A * | 4/1993 |

*Primary Examiner*—Gary L. Welch
*Assistant Examiner*—Nathan E Durham
(74) *Attorney, Agent, or Firm*—Watson I.P. Group, P.L.C.; Jovan N. Jovanovic; Vladan M. Vasiljevic

(57) ABSTRACT

A garment hanger comprising a body, a hook member and a first and second clamp assembly. The body includes a beam member, a first end and a second end. The beam member has an upper flange and a lower flange spaced apart from the upper flange. Additionally, a first web portion extends from and is oblique to the upper flange. A second web portion extends from and is oblique to the lower flange. The two web portions intersect each other between the upper and lower flanges. The hook member is coupled to the body. The clamp members are positioned on opposing sides of the body. One or both of the clamp assemblies include a rear assembly half and a front assembly half. The two halves are pivotally coupled to each other. Each half has a garment engaging surface and a spring receiving region. The spring receiving region is configured to receive at least two spring members. At least one spring member is coupled to the spring receiving region so as to bias the garment engagement surfaces toward each other.

9 Claims, 10 Drawing Sheets

U.S. PATENT DOCUMENTS

| | | | | | |
|---|---|---|---|---|---|
| D352,834 | S | | 11/1994 | Norman | |
| 5,398,854 | A | | 3/1995 | Blanchard | |
| 5,400,932 | A | | 3/1995 | Hollis | |
| D409,006 | S | | 5/1999 | Blanchard | |
| 5,915,605 | A | | 6/1999 | Blanchard | |
| D415,357 | S | | 10/1999 | Blanchard | |
| 6,019,261 | A | | 2/2000 | Morgan et al. | |
| 6,021,933 | A | * | 2/2000 | Zuckerman | 223/96 |
| 6,023,819 | A | | 2/2000 | Wong et al. | |
| 6,050,462 | A | * | 4/2000 | Petrou et al. | 223/96 |
| D429,898 | S | | 8/2000 | Morgan et al. | |
| 6,098,254 | A | | 8/2000 | Willinger | |
| 6,105,836 | A | | 8/2000 | Batts et al. | |
| 6,116,482 | A | * | 9/2000 | Heiber | 223/96 |
| 6,119,906 | A | * | 9/2000 | Bond et al. | 223/96 |
| D435,173 | S | | 12/2000 | Morgan et al. | |
| D436,743 | S | | 1/2001 | Batts et al. | |
| 6,173,872 | B1 | | 1/2001 | Cohen | |
| 6,305,586 | B1 | | 10/2001 | Wong | |
| D450,463 | S | | 11/2001 | Wong et al. | |
| D463,918 | S | | 10/2002 | Goldman et al. | |
| D464,814 | S | | 10/2002 | DeWinter et al. | |
| 6,474,517 | B1 | * | 11/2002 | Sutton | 223/96 |
| D466,311 | S | | 12/2002 | Hawkins | |
| D466,704 | S | | 12/2002 | Hawkins | |
| D466,705 | S | | 12/2002 | Hawkins | |
| D472,394 | S | | 4/2003 | Hawkins | |
| 6,609,640 | B1 | | 8/2003 | Bokmiller | |
| 6,612,000 | B2 | | 9/2003 | Housley | |
| D502,328 | S | | 3/2005 | Gouldson | |
| D504,024 | S | | 4/2005 | Mainetti | |
| D506,320 | S | | 6/2005 | Gouldson | |
| 6,923,350 | B2 | | 8/2005 | Gouldson et al. | |
| D518,838 | S | | 4/2006 | Singleton | |
| D518,839 | S | | 4/2006 | Singleton | |
| D519,139 | S | | 4/2006 | Singleton | |
| 7,150,381 | B2 | * | 12/2006 | Goldman | 223/91 |
| 2004/0099700 | A1 | * | 5/2004 | Misumi | 223/96 |
| 2007/0151998 | A1 | * | 7/2007 | Wong | 223/85 |

* cited by examiner

GARMENT HANGER HAVING CLAMP ASSEMBLIES

CROSS-REFERENCE TO RELATED APPLICATION

The present application is a continuation in part of U.S. patent application Ser. No. 11/509,838 filed Aug. 24, 2006, entitled "Garment Hanger Having Clamp Assemblies," the entire specification of which is incorporated by reference herein in its entirety.

BACKGROUND OF THE INVENTION

1. Field of the Invention

The invention relates in general to garment hangers, and more particularly, to a garment hanger having clamp assemblies. The clamp assemblies are configured for the receipt of one or more spring members so as to vary the gripping force retaining the garment between the clamp assemblies.

2. Background Art

The use of garment hangers having various clamping mechanisms is well known in the art. Garment hangers of this type are typically employed to retain dresses, swimsuits, and a number of different garments, typically garments for the lower torso.

In certain instances, these garment hangers are applied to products at the garment manufacturing or shipping facility. These garments are typically shipped on garment hangers in shipping containers from the location of manufacture (often the far east) to locations throughout the world. In other instances, the garments are applied to the hangers at the retail location. Furthermore, the garment hangers are handled and operated by consumers. While such garment hangers have greatly increased in popularity, there nevertheless exist enhancements which can be made to these garment hangers to improve their usability and reliability.

Problematically, typical garment hangers comprise a body which is of an "I" beam construction or a "C" channel construction. With garments that include elastic or other stretch-type material, there has been a tendency for such garment hanger bodies to bend or curl such that the clamps turn, typically, inwardly toward each other. With the constant pressure of raw material costs (i.e., costs of resins and plastic materials), it is quite undesirable to increase the quantity of material utilized for body. Thus, it is not desirable to increase, for example, the thickness of these members. Moreover, the addition of a number of reinforcements or ribs often has a negative impact on cost and aesthetics. It would be desirable to determine an alternate structure which minimizes the use of material but which enhances the rigidity and appearance of the body member.

Another problem that has been experienced with these type of garment hangers is that often the clamping force of the clamping members is not well suited to different fabrics. For example, for certain types of garments, a relatively strong clamping force is necessary. Whereas for other garments, such a strong clamping force is typically destructive to the underlying fabric and garment, and it is likewise difficult to attach the garment to the hanger. A typical factory may produce a number of different products. As such, it is often necessary to have a number of different clamp springs during hanger production. Often times, this leads to an expanded inventory and an increase in the number of parts required to assemble various hangers. As certain parts are not available, unsuitable hangers are often utilized for a garment. It would be advantageous to provide a garment hanger for which the clamping force could be adjusted with a minimal number of hanger components to inventory or to otherwise utilize.

It is an object of the present invention to provide a body structure which increases rigidity.

It is another object of the present invention to provide a body structure which, while increasing rigidity and usability, minimizes raw material usage.

It is another object of the invention to provide a body structure which, while increasing rigidity and usability, provides an aesthetically pleasing and clean configuration.

It is another object of the invention to provide a garment hanger which, through common components, includes the ability to vary the clamping force exerted by the clamping members.

These objects as well as other objects of the present invention will become apparent in light of the present specification, claims, and drawings.

SUMMARY OF THE INVENTION

To address the objects set forth above, as well as other objects, in a first aspect of the invention, a garment hanger is disclosed. The garment hanger comprises a body, a hook member and a first and second clamp assembly. The body includes a beam member, a first end and a second end. The beam member has an upper flange and a lower flange spaced apart from the upper flange. The hook member is coupled to the body. The clamp members are positioned on opposing sides of the body. One or both of the clamp assemblies include a rear assembly half and a front assembly half. One of the rear assembly half and the front assembly half have a rear pivot structure including an outer hinge tab and an inner hinge tab. The other of the rear and front assembly halves include an outer hinge slot and an inner hinge slot. The inner hinge slot cooperates with the inner hinge tab and the outer hinge slot cooperates with the outer hinge tab, so that the front assembly half and the rear assembly half are pivotably coupled to each other. The front and rear assembly halves include a garment engagement surface and at least one spring receiving region configured for receiving a spring member. The clamp assembly further includes a clamp locking assembly comprising a locking tab positioned on one of the front assembly half and the rear assembly half, along with a locking slot positioned on the other of the front assembly half and the rear assembly half. The locking tab interfaces with the locking slot so as to preclude disengagement of the front assembly half from the rear assembly half. The at least one spring is coupled to the at least one spring receiving region of each of the front and rear assembly halves. In turn, the spring biases the garment engagement surfaces of each of the front and rear assembly halves toward each other.

In a preferred embodiment, the locking tab is positioned on the rear assembly half and positioned between the one of the pair of hinge tabs and the hinge slots. The locking slot is correspondingly positioned between the other of the pair of hinge tabs and the pair of hinge slots.

In a preferred embodiment, the at least one hinge slot comprises a pair of hinge slots. Each slot is positioned between the combination of the locking tab and the locking slot and the respective combination of the outer hinge tab with the outer hinge slot and the inner hinge tab with the inner hinge slot.

In another preferred embodiment, the body further includes a first deflecting member and a second deflecting member. The first deflecting member is positioned at opposing ends of the beam member, resulting in a thickness at least that of a respective one of the first clamp assembly and second clamp assembly proximately positioned.

In a preferred embodiment, the first and second clamp assemblies are substantially identical.

In yet another preferred embodiment, the spring receiving region of the front assembly half comprises a pair of spaced apart openings and a spring receiver corresponding to each opening positioned on an outer surface of the front assembly half. Similarly, the spring receiving assembly of the rear assembly half comprises a pair of spaced apart openings and a spring receiver corresponding to each opening positioned on an outer surface of the rear assembly half. Each spring member extends through an opening in each of the front and rear assembly halves, and is received in a corresponding spring receiver associated with the respective opening.

In such a preferred embodiment, the at least one spring member comprises a pair of spring members each spring member coupled to the spring receiving region of each of the front assembly half and rear assembly half.

In another preferred embodiment, each spring member comprises a substantially "U" shaped spring member having a central region, a first leg region and a second leg region.

Preferably, each spring receiver comprises a channel extending along an outer surface of each of the front assembly half and rear assembly half.

BRIEF DESCRIPTION OF THE DRAWINGS

The invention will now be described with reference to the drawings wherein.

DETAILED DESCRIPTION OF THE INVENTION

Figure 1:
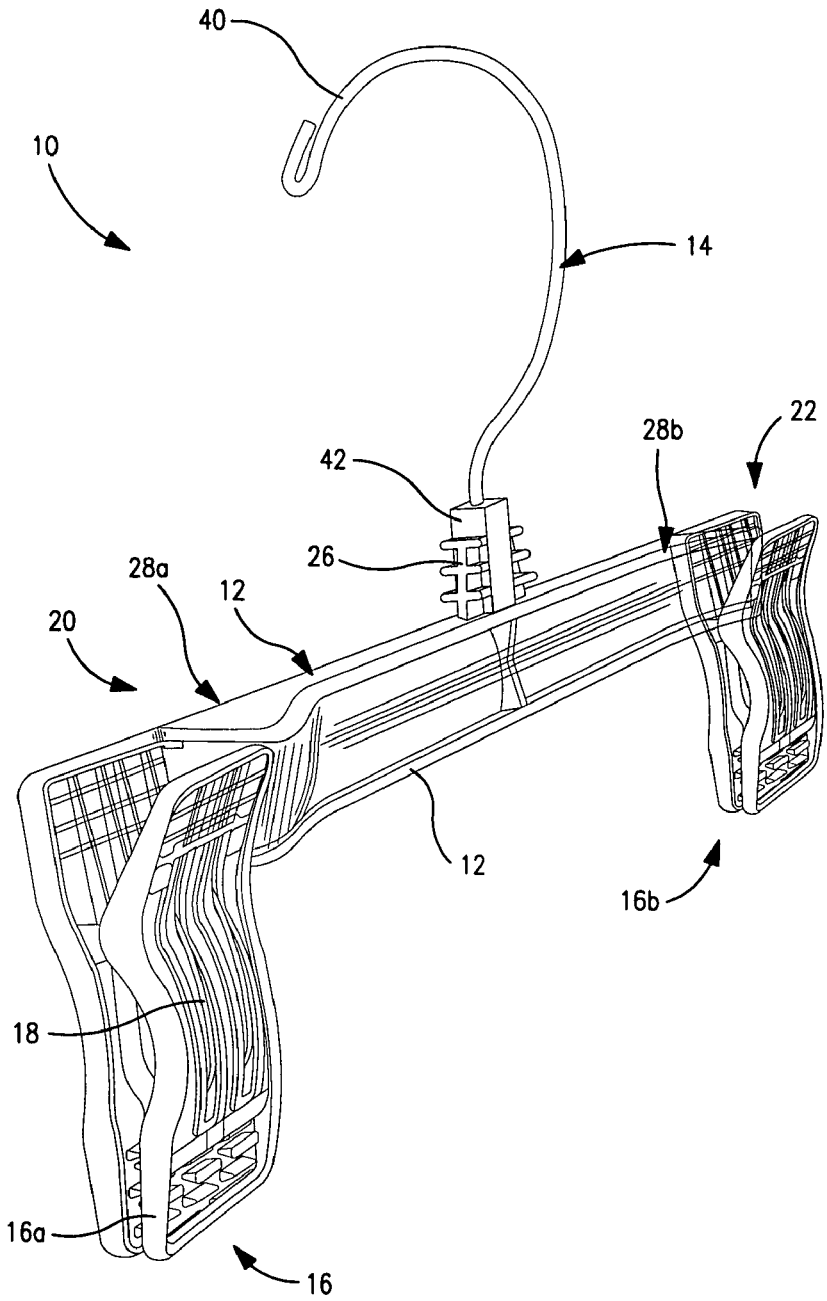
FIG. 1 of the drawings is a perspective view of the garment hanger of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
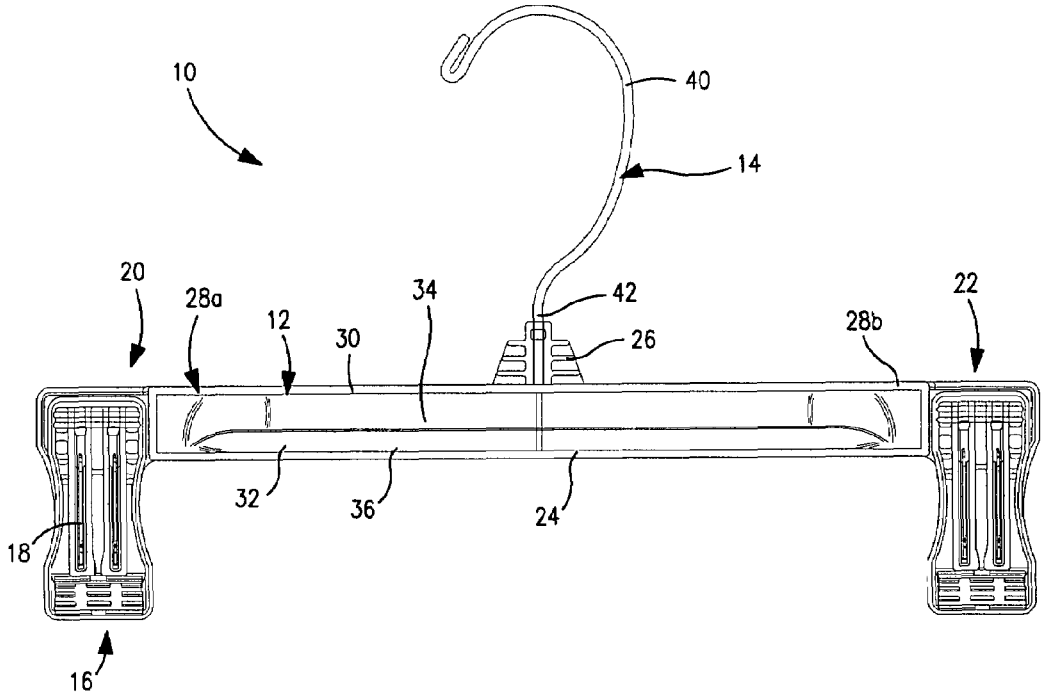
FIG. 2 of the drawings is a front plan view of the garment hanger of the present invention.
Figure 3:
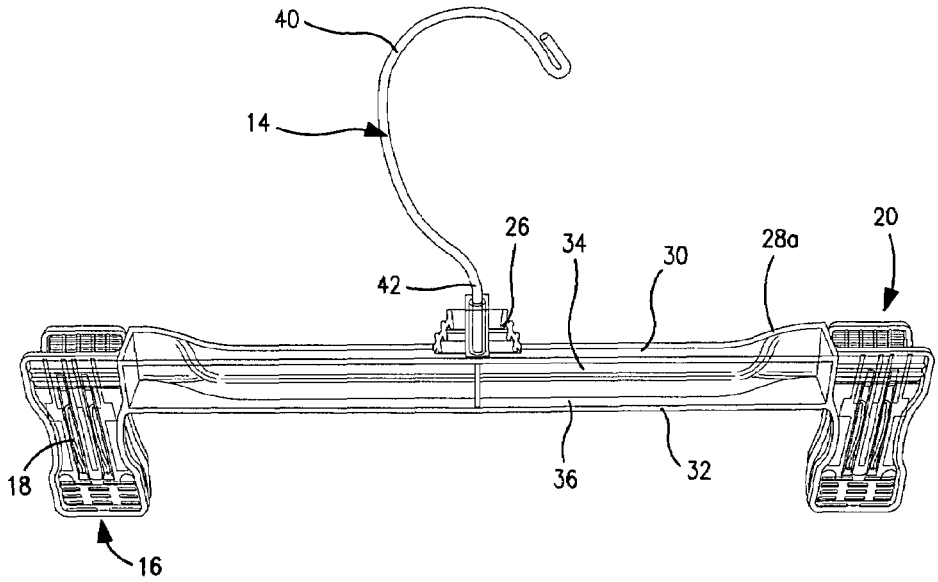
FIG. 3 of the drawings is a back plan view of the garment hanger of the present invention.
Figure 4:
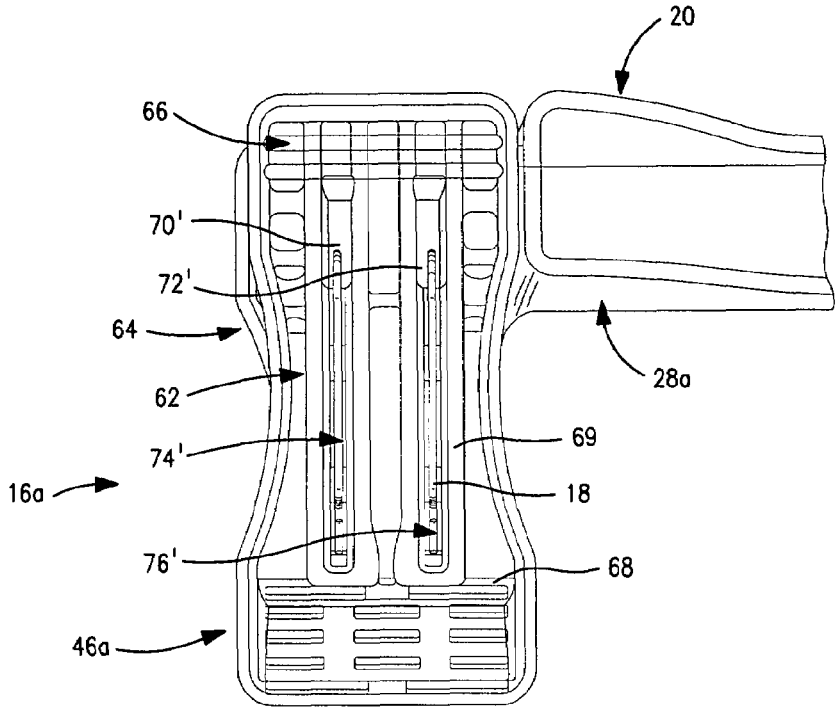
FIG. 4 of the drawings is a partial front plan view of the garment hanger of the present invention, showing in particular the first clamping assembly.
Figure 5:
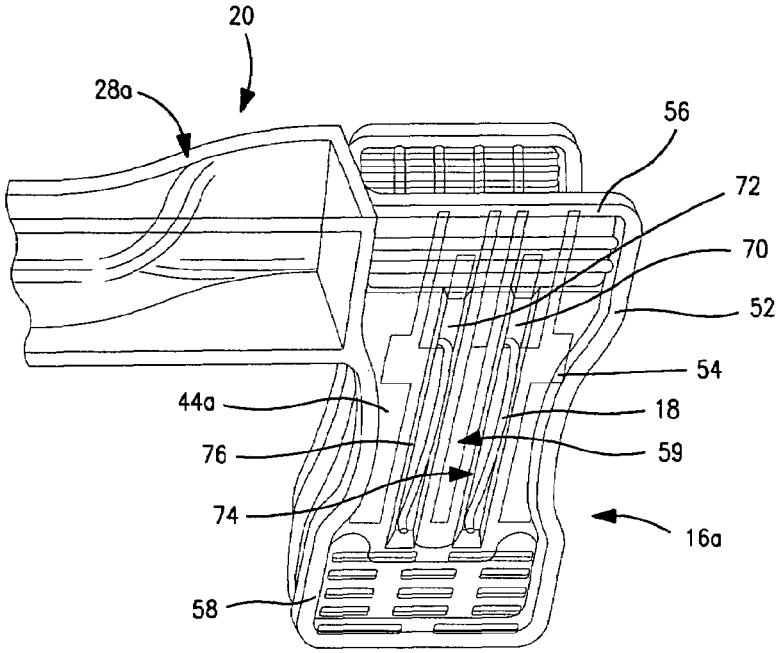
FIG. 5 of the drawings is a partial back plan view of the garment hanger of the present invention, showing in particular the first clamping assembly.
Figure 6:
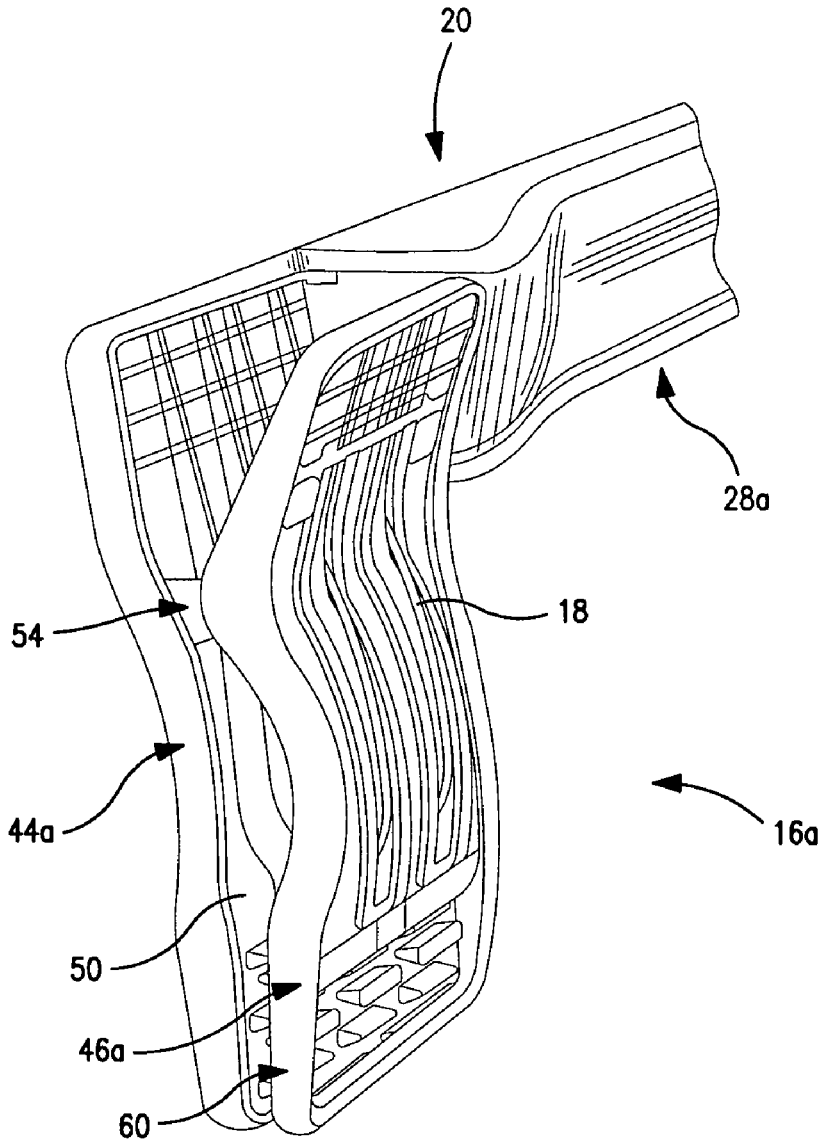
FIG. 6 of the drawings is a partial perspective view of the garment hanger of the present invention, showing in particular the first clamping assembly.

Referring now to the drawings and in particular to FIG. 1, garment hanger 10 is shown in FIGS. 1, 2 and 3 as comprising body 12, hook 14, clamp assemblies 16 and spring member 18. Typically body 12 is formed from a polymer resin material such as, for example, styrene-butadiene. One such material is commonly referred to as K RESIN and is manufactured by Phillips petroleum. Another material manufactured by BASF is sold under the name SYROLUX. Of course, the material is not limited to the foregoing.

Hook 14 is shown in the figures as comprising a separate member which is formed from a metal or alloy thereof. In the embodiment shown, hook 14 is a separate member which is attached to the body 12 and typically freely rotatable thereagainst. In other embodiments, the hook member may be fixed to the body. In still other embodiments, the hook member may be integrally molded with the body 12, and thereby formed from similar or identical materials.

Figure 7:
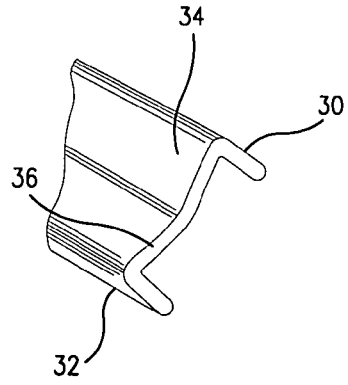
FIG. 7 of the drawings is a cross-sectional view of the beam member of the garment hanger of the present invention.

More specifically, body 12 includes first end 20, second end 22, beam member 24 hook boss 26 and deflecting members 28*a*, 28*b*. Beam member 24 extends at least partially between first end 20 and second end 22. Preferably, the beam member extends to the opposing deflecting members 28*a*, 28*b*. As is shown in greater detail in FIG. 7, the beam member includes upper flange 30, lower flange 32, first web portion 34 and second web portion 36. The upper flange 30 is separated from lower flange 32 and generally substantially parallel thereto. First web portion 34 extends from upper flange 30 toward lower flange 32 at an oblique angle. Second web portion 36 extends from lower flange 32 to upper flange 30 at an oblique angle.

The two web portions intersect between the first and second flanges so as to, collectively with the upper and lower flanges, define a substantially "M" shaped cross-section for beam member 24. Preferably, the two web portions are inclined at similar angles, such that they intersect midway between the upper and lower flanges, and such that the width of the flanges and the width of the web is substantially the same. For example, the first and second web portions are substantially mirror images of each about a plane which extends through the intersection of the first and second web portions and which is substantially parallel to one or both of the upper and lower flanges.

In certain embodiments, the web portion may be contoured slightly (or the intersection may include a fillet) such that the web has a substantially "U" like configuration. Such a configuration greatly increases the strength of the beam member while providing a relatively large web which is at least partially planar. Moreover, the quantity of material utilized in the body of the hanger can be minimized while enhancing the strength of the underlying beam member.

Hook boss 26 extends from the upper flange 30 and interfaces with the hook member so as to retain the hook member in engagement with the body of the garment hanger. In certain embodiments, the hook boss may be formed integrally with both the body and the hook member. While not shown, the hook boss may be configured so as to receive any one of a number of different sizing systems.

Deflecting members 28*a*, 28*b* are positioned at opposing ends of the body 12. The deflecting members increase the thickness from the narrower thickness of the beam member to the wider clamp assemblies (and even wider in certain embodiments), thereby forming a transition therebetween. The deflecting members deflect objects and substantially minimize the interference of outside objects with the clamp assemblies. In the embodiment shown, the upper and lower flanges continue throughout the deflecting members, increasing in width, whereas the web surface transitions to a substantially planar surface which is substantially perpendicular to the two flanges.

Hook 14 is shown in FIG. 1 as comprising head end 40 and tail end 42. In the embodiment shown, the head end is configured with a typical radius so as to engage outside hanging surfaces. The tail end 42 is configured so as to engage the hook boss and to be retained thereby. As set forth above, the hook 14 may be a separate member or may be integrally molded with the body 12 of the garment hanger.

Clamp assemblies 16 are shown in FIG. 1 as comprising first clamp assembly 16*a* and second clamp assembly 16*b*, which are positioned on opposing sides of body 12. First clamp assembly 16*a* will be described in detail with the understanding that the second clamp assembly 16*b* is substantially identical. It will be understood, however, that the clamp assemblies 16*a* and 16*b* are not required to be identical, and variations between the two clamp assemblies are considered to be within the scope of the present invention.

Figure 9:
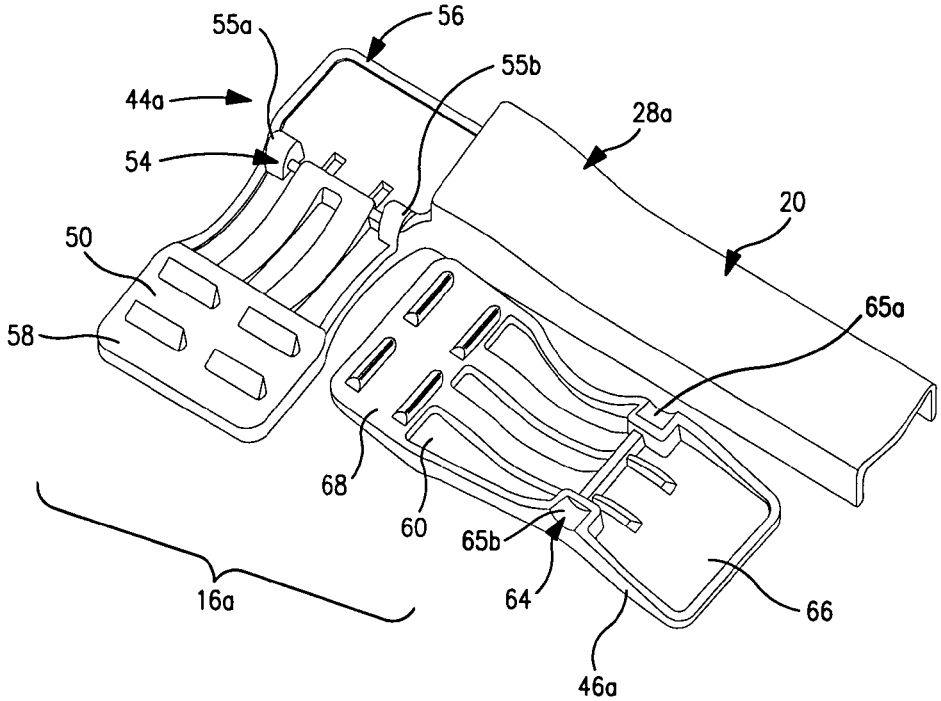
FIG. 9 of the drawings is a partial exploded perspective view of the garment hanger of the present invention, showing, in particular, the inner surfaces of the first clamping assembly.
Figure 10:
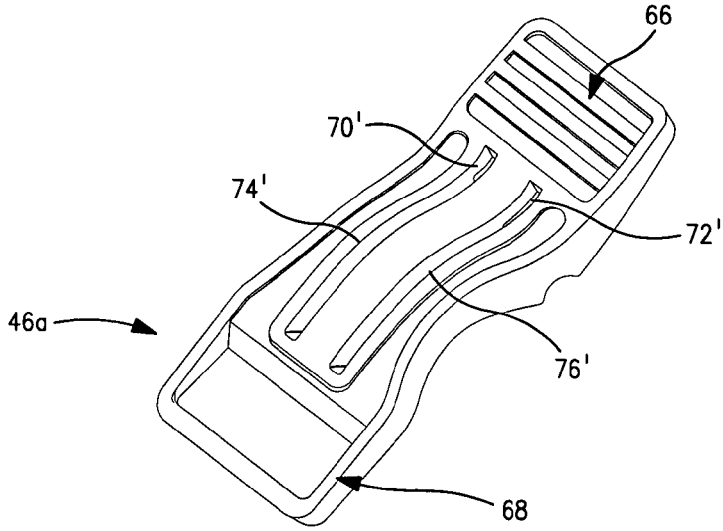
FIG. 10 of the drawings is a perspective view of a first clamping assembly of the garment hanger of the present invention.

First clamp assembly 16*a* is shown in one of FIGS. 4 through 6, 9 and 10 as comprising rear assembly half 44*a* and front assembly half 46*a*. While not limited thereto, rear assembly half 44*a* is integrally formed with body 12 and is positioned at first end 20 thereof, outboard of deflecting member 28*a*. The rear assembly half includes inner surface 50 and outer surface 52. Rear pivot structure 54 is positioned on inner surface 50. With reference to FIG. 9, Rear pivot structure 54 includes outer hinge tab 55*a* and inner hinge tab 55*b*. The inner hinge tab and the outer hinge tab are spaced apart from each other. Rear finger engagement surface 56 extends on one side of the rear pivot structure, and garment engagement surface 58 extends on the opposing side of the rear pivot structure.

Spring receiving assembly 59 is likewise disposed on the rear assembly half 44*a*. Spring receiving assembly 59 includes openings, such as openings 70, 72 and spring receivers 74, 76. In the embodiments shown, the spring receivers comprise channels which extend from the respective openings 70, 72 along the outer surface 52 of the rear assembly half 44*a*. The spring receiving assembly providing a means for accepting a plurality of spring members. The plurality of spring members provide an ability to vary the spring force by providing a plurality of the spring members.

Front assembly half 46*a* is shown in one of FIGS. 4 through 6, 9 and 10 as comprising inner surface 60 and outer surface 62. The front assembly half further includes front pivot structure 64 which matingly engages rear pivot structure 54 so as to permit relative pivoting of the rear assembly half and the front assembly half therearound. In particular, and with reference to FIG. 9, the front pivot structure 64 includes outer hinge slot 65*a* and inner hinge slot 65*b*. The outer hinge slot 65*a* is configured to receive outer hinge tab 55*a*. The inner hinge slot 65*b* is configured to receive inner hinge tab 55*b*. Front finger engagement surface 66 opposes rear finger engagement surface 56 and front garment engagement surface 68 opposes rear garment engagement surface 58.

With such a configuration, a garment is retained between the garment engagement surfaces 58, 68 and the finger engagement surfaces are engaged to separate the garment engagement surfaces through pivoting about the front and rear pivot structures 54, 64, to, in turn, release the garment therefrom.

In one embodiment, such as the embodiment shown in FIGS. 11 through 18, the clamp assemblies 16 may further include a clamp locking assembly 21. It will be understood that the clamp locking assembly 21 will be shown relative to clamp assembly 16*a* with the understanding that the other clamp assembly 16*b* may likewise include such a structure. As will be explained below, the clamp locking assembly precludes the inadvertent separation of the front assembly half 46*a* from the rear assembly half 44*a*, as the front and rear pivot structures are not positively secured to each other in the embodiment shown, but are retained in position by the springs. Of course, where the front and rear pivot structures are positively engaged, such a clamp locking assembly would provide additional securement.

Figure 11:
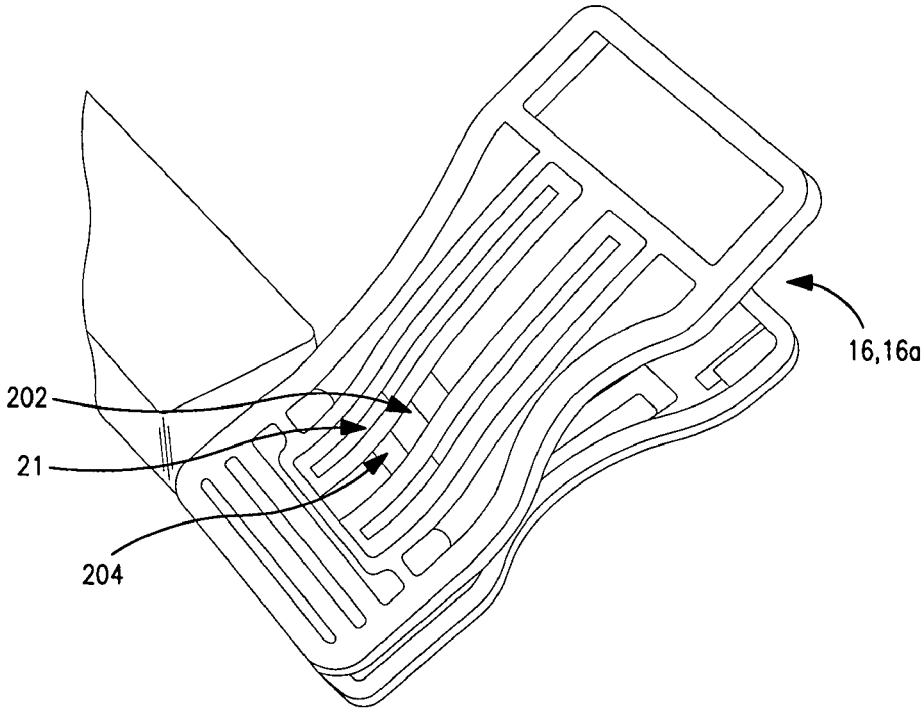
FIG. 11 of the drawings is a partial perspective view of a second embodiment of the garment hanger of the present invention, showing in particular, a clamp assembly with a clamp locking assembly.
Figure 12:
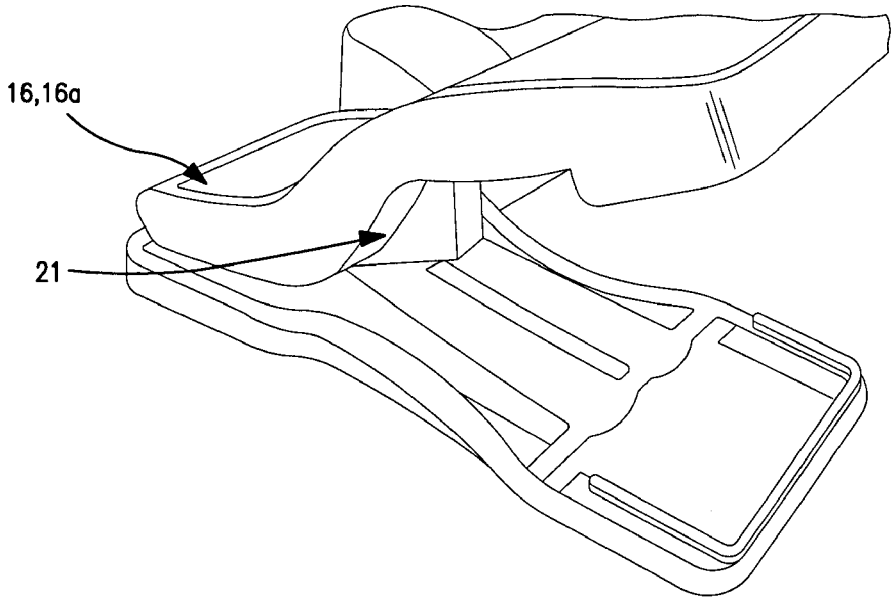
FIG. 12 of the drawings is a partial perspective view of the second embodiment of the garment hanger of the present invention, showing in particular, a clamp assembly with a clamp locking assembly.
Figure 13:
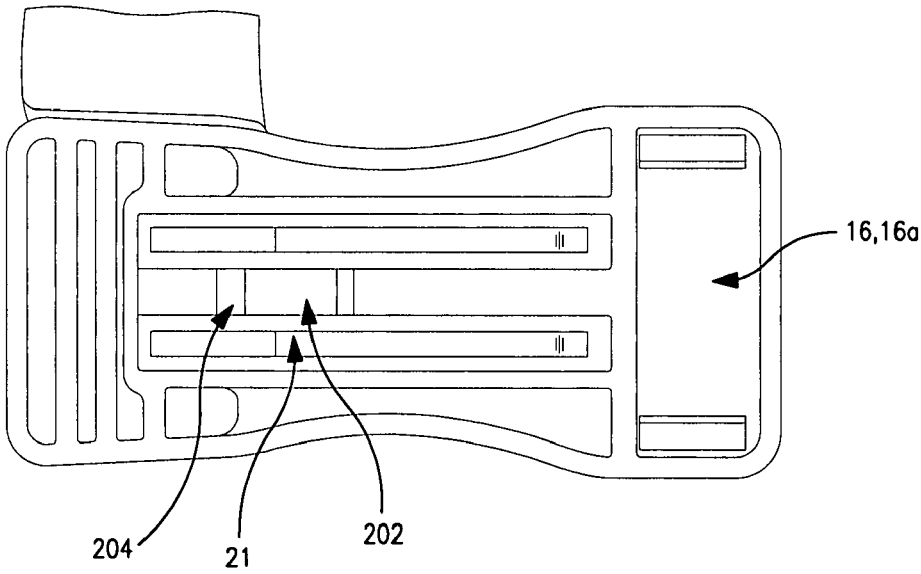
FIG. 13 of the drawings is a partial top plan view of the second embodiment of the garment hanger of the present invention, showing in particular, a clamp assembly with a clamp locking assembly.
Figure 14:
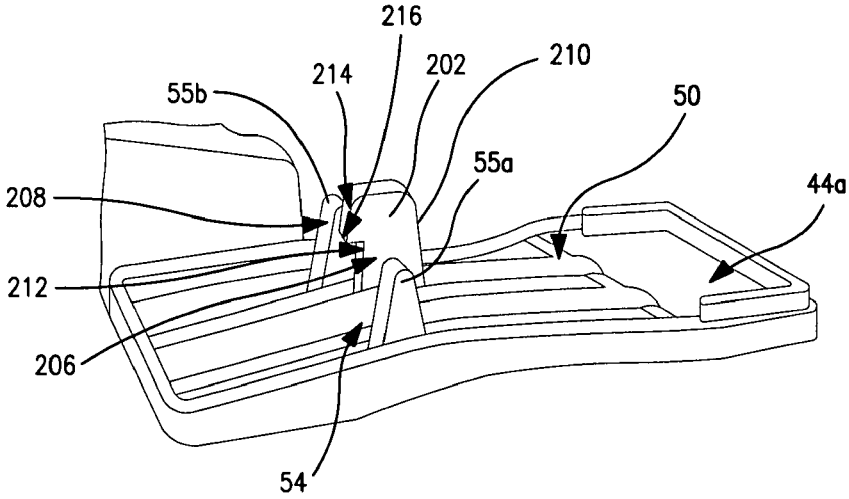
FIG. 14 of the drawings is a partial perspective view of the second embodiment of the garment hanger of the present invention, showing in particular, the rear clamp assembly half having a clamp locking assembly.
Figure 15:
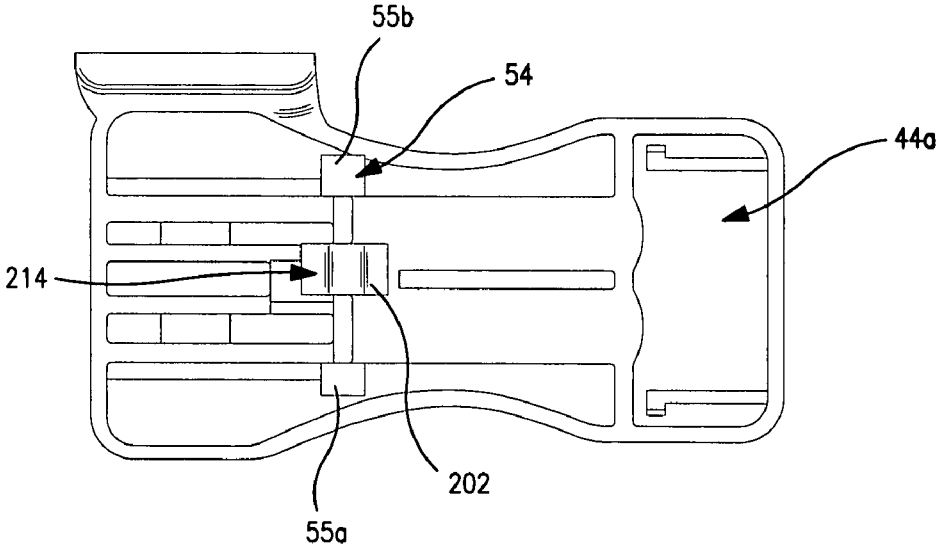
FIG. 15 of the drawings is a partial top plan view of the second embodiment of the garment hanger of the present invention, showing in particular, the rear clamp assembly half having a clamp locking assembly.

With reference to FIGS. 11 through 13, the clamp locking assembly 21 includes locking tab 202 and locking slot 204. With reference to FIGS. 14 and 15, the locking tab 202 includes trunk member 206 and leg member 208. The trunk member extends outwardly from the inner surface 50 of the rear assembly half 44*a*. The trunk member 206 includes a substantially rectangular cross-sectional configuration and includes front surface 210 and back surface 212 opposing the front surface 210. The front and back surfaces are spaced apart from each other.

Leg 208 is shown in FIG. 14 as comprising incline surface 214 and lower lip 216. The incline surface is positioned at the top of the leg 208 and the lower lip 216 opposes the incline surface. The incline surface is directed toward the lower lip 216 as the leg 208 extends away from the trunk member 206. In the embodiment shown, the locking tab 202 is molded together with the rear assembly half of the first clamp assembly 16*a*.

Figure 16:
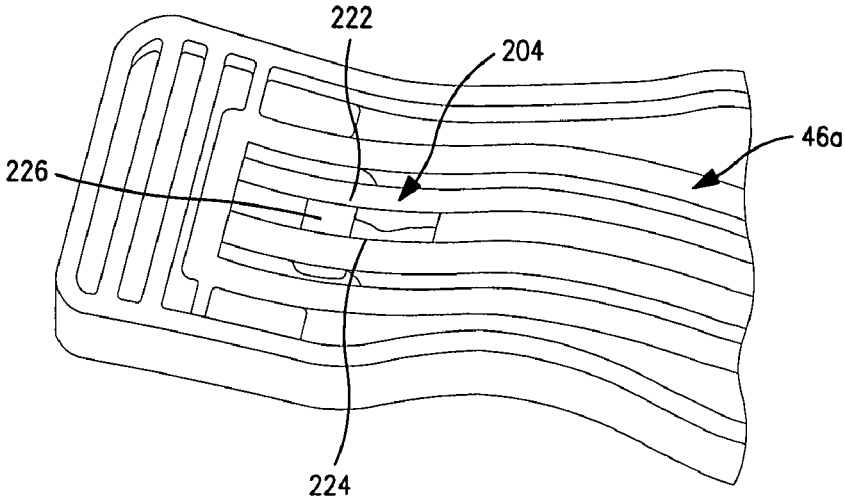
FIG. 16 of the drawings is a partial perspective view of the front clamp assembly half of the second embodiment of the garment hanger of the present invention, showing in particular, a portion of the clamp locking assembly.
Figure 17:
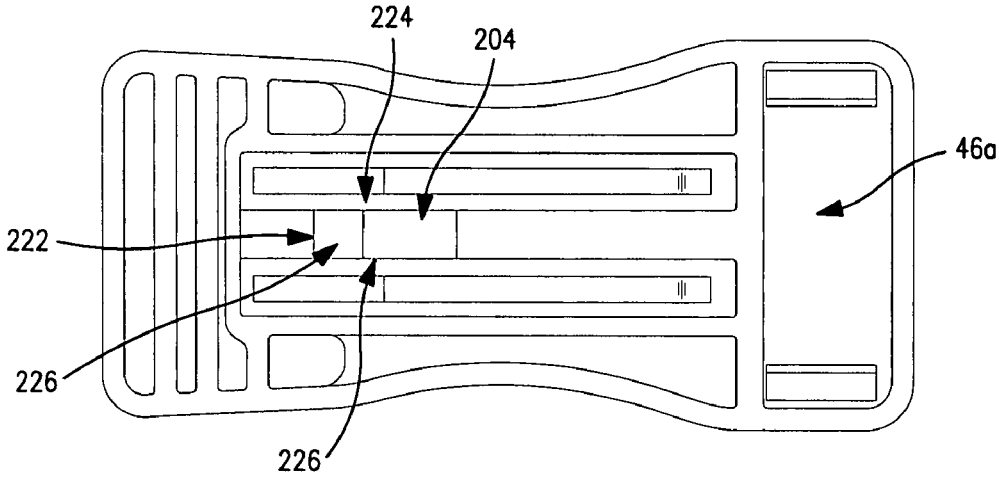
FIG. 17 of the drawings is a top view of the front clamp assembly half of the second embodiment of the garment hanger of the present invention, showing in particular, a portion of the clamp locking assembly.
Figure 18:
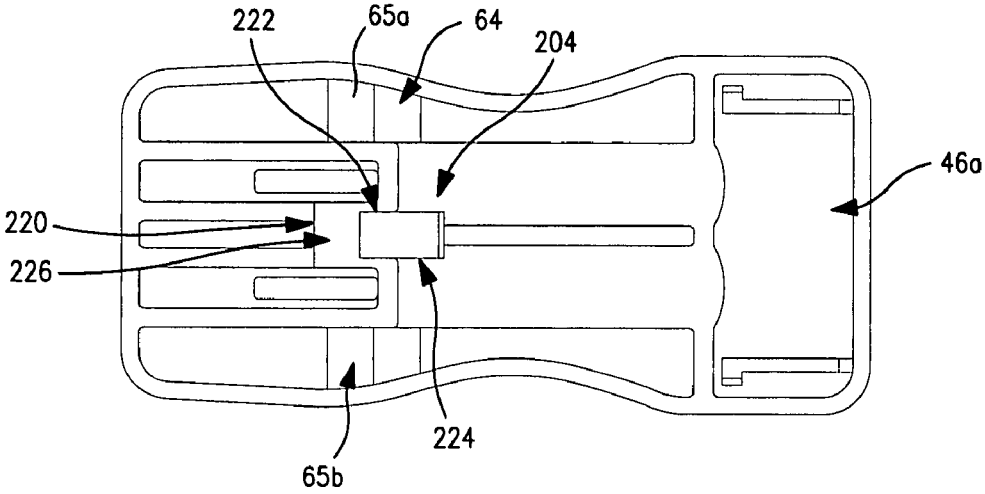
FIG. 18 of the drawings is a bottom plan view of the front clamp assembly half of the second embodiment of the garment hanger of the present invention, showing in particular, a portion of the clamp locking assembly.

Locking slot 204 is shown in FIGS. 16 through 18 as comprising back surface 220, side surfaces 222 and 224, and ledge 226. The locking slot is positioned on the front assembly half 46*a* positioned between outer hinge slot 65*a* and inner hinge slot 65*b*, such that when the front pivot structure 64 and the rear pivot structure 54 are mated, the locking tab 202 and the locking slot 204 are in a generally overlaying configuration.

The ledge 226 is positioned so as to bridge the area between side surfaces 222 and 224 proximate back surface 220, and provides a web which contacts the lower lip 216 of the leg 208 when the clamp assembly is in a closed orientation.

Front spring receiving assembly 69 is configured in a manner similar to that of the rear spring receiving region 59. In particular, the spring receiving assembly includes openings, such as openings 70, 72 (which correspond in position to the openings 70', 72') and spring receivers 74', 76'.

Figure 8:
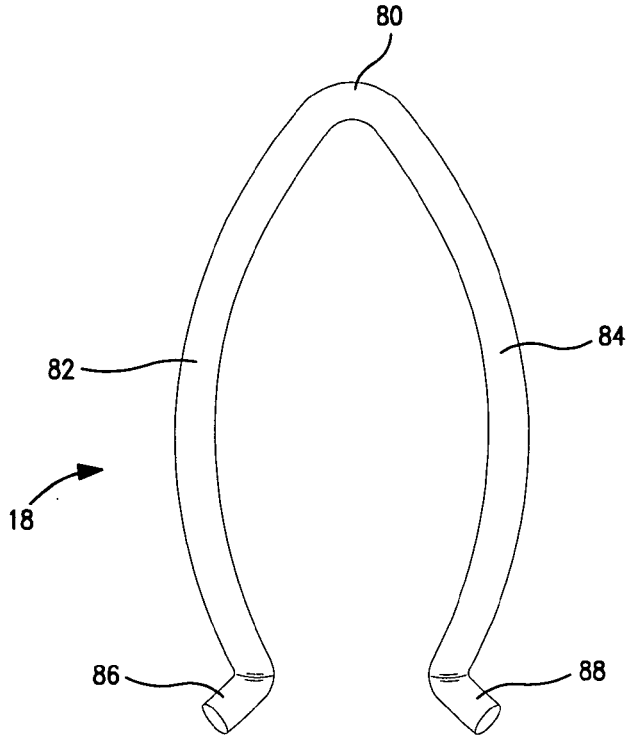
FIG. 8 of the drawings is a side elevational view of a spring member of the garment hanger of the present invention.

Spring assembly 18 is shown in FIG. 8 in greater detail as comprising a plurality of springs that are interfaced with the spring receiving regions of the respective clamp assemblies 16. Each spring comprises a central region 80, first leg 82, second leg 84. First leg 82 terminates in flared end 86 and second leg 84 terminates in flared end 88. The springs are substantially "u" shaped with the legs being elongated on opposing sides of the central region. It is contemplated that other types of springs, such as springs having coils positioned therein, as well as other biasing structures are contemplated for use. Spring 18 will be described with the understanding that the remaining springs are substantially situated.

Specifically, spring 18 is extended through each of openings 70 and 70' and the opposing legs are directed into spring receivers 74, 74' on opposing assembly halves. The spring is configured so that the opposing garment engagement surfaces 58, 58' are forced into each other and that force applied to the opposing fingers is necessary to separate same.

It will be understood that an additional spring may be extended through the openings 72, 72' and into spring receivers 76, 76'. Although the two springs may be identical in configuration, the inclusion of a plurality of springs increases the force applied against the garment engagement surfaces. It will be understood that while the spring receiving assemblies show the inclusion of two springs, additional provisions may be provided for including any number of springs. Moreover, a uniform spring can be selected, wherein variations in the number of springs utilized, comprises the adjustment mechanism. In other embodiments, various springs having different biasing forces can be utilized (and for example, segregated by color, etc.).

To assemble the garment hanger of the present invention, the body 12 is first provided. Once provided, the hook can be coupled to the body (where a separate hook member is provided). Specifically, tail end 42 of hook 14 is inserted into hook boss 26 and releasably retained thereby. In certain embodiments, the body is heated (i.e., softened), whereupon the tail end of the hook is inserted. The body is then cooled which results in a coupling of the two components.

Next, front assembly half 46*a* is positioned so as to overlay the rear assembly half 44*a*. In particular, the pivoting structures of each of the clamp assembly halves 54, 64 are coupled together. More specifically, and with reference to FIG. 9, the outer hinge tab 55*a* is positioned into outer hinge slot 65*a*, and, the inner hinge tab 55*b* is positioned in the inner hinge slot 65*b*.

With the embodiment of FIGS. 11 through 18, having clamp locking assembly 21, as the hinge slots and tabs are brought into contact, the incline surface 214 of leg 208 of locking tab 202, abuts an inner edge of ledge 226, which moves the front assembly half forward allowing the leg 208 to pass beyond ledge 226 until the leg is captured within the locking slot 204. Due to the configuration of the hinge tabs and slots, the front assembly half moves backward so that any attempt at vertical separation is precluded by contact between the ledge 226 and the lower lip 216 of the leg 208. Slidable separation is precluded by the back surface 220 of the locking slot 204.

In order to separate the two assembly halves, it is necessary to first rotate the front assembly half toward an open configuration, wherein the rear finger engagement surfaces 56 are brought toward and into contact with each other. At such time, the back surface 220 has been rotated out of the way of the back surface 212 of the trunk 206, so as to permit lifting and slidable disengagement of the two components.

Once the two are positioned relative to each other, a determination is made as to the amount of spring force required for the particular application. For example, if only a single spring member is required, the spring member is coupled to the each of the front and rear assembly halves. Specifically, the spring is extended through each of openings 70, 70' and inserted into the spring retainers 74, 74'.

If a greater force is required, a second spring can be employed. The second spring is inserted into openings 72, 72' and into spring retainers 76, 76'. The second spring then lies substantially parallel to and spaced apart from the first spring and provides additional clamping force. This same process can be repeated for the second clamp assembly 16*b*.

For example, for lighter garments, such as swimsuits and the like, a single clamp may suffice. Indeed, a greater clamping force may be destructive to what is typically a finer and more delicate material. On the other hand, for heavier garments like wool skirts and the like, the additional clamping force is required to overcome the pulling downward force created by the shear weight of the garment.

Advantageously, in the preferred embodiment, each of the spring members is substantially identical. As such, variations in force can be achieved without resorting to the use of a plurality of different spring members. Problematically, the use of different spring members requires an assembly operation to maintain inventory of a number of different springs. In the present invention, preferably, a single spring is utilized, and differences in the spring force needed is addressed through the use of multiple springs on a single clamp assembly. Moreover, with the clamp locking assembly, even with strong movement during transport or by a consumer the front assembly half and the rear assembly half will remain in operative engagement and will preclude the detachment of the components from each other.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A garment hanger comprising:

a body having a beam member, a first end and a second end, the beam member having an upper flange and a lower flange spaced apart from the upper flange;

a hook member coupled to the body;

a first clamp assembly and a second clamp assembly, the first clamp assembly positioned at the first end of the body and the second clamp assembly positioned at the second end of the body, at least one of the clamp assemblies comprising, a rear assembly half and a front assembly half, one of the rear assembly half and the front assembly half having a rear pivot structure including an outer hinge tab and an inner hinge tab, the other of the rear assembly half and the front assembly half having a front pivot structure having an outer hinge slot and an inner hinge slot, wherein the inner hinge slot cooperates with the inner hinge tab and the outer hinge slot cooperates with the outer hinge tab to pivotably couple the front assembly half and the rear assembly half to each other, each of the front and rear assembly halves having a garment engagement surface, and at least one spring receiving region configured for receiving a spring member;

a clamp locking assembly comprising a locking tab extending from the rear assembly half, the locking tab positioned between the outer and inner hinge tabs and including a trunk member extending upwardly and a leg member defining a lower lip, and a locking slot positioned on the front assembly half between the outer hinge slot and the inner hinge slot, corresponding to the locking tab, the locking slot defining an opening and including a ledge, wherein the trunk member extends into the locking slot and the lower lip interfaces with the ledge so as to preclude disengagement of the front assembly half from the rear assembly half in a plurality of relative orientations; and at least one spring member coupled to the at least one spring receiving regions of each of the front and rear assembly halves, to, in turn, bias the garment engagement surfaces of each of the front and rear assembly halves toward each other.

2. The garment hanger of claim 1 wherein the body further includes a first deflecting member and a second deflecting member, the first deflecting member positioned at opposing ends of the beam member, resulting in a thickness at least that of a respective one of the first clamp assembly and second clamp assembly proximately positioned.

3. The garment hanger of claim 1 wherein the first and second clamp assemblies are substantially identical.

4. The garment hanger of claim 1 wherein the spring receiving region of the front assembly half comprises a pair of spaced apart openings and a spring receiver corresponding to each opening positioned on an outer surface of the front assembly half, the spring receiving assembly of the rear assembly half comprises a pair of spaced apart openings and a spring receiver corresponding to each opening positioned on an outer surface of the rear assembly half, each spring member extending through an opening in each of the front and rear assembly halves, and received in a corresponding spring receiver associated with the respective opening.

5. The garment hanger of claim 4 wherein the at least one spring member comprises a pair of spring members each spring member coupled to the spring receiving region of each of the front assembly half and rear assembly half.

6. The garment hanger of claim 5 wherein each spring member comprises a substantially "U" shaped spring member having a central region, a first leg region and a second leg region.

7. The garment hanger of claim 6 wherein each spring receiver comprises a channel extending along an outer surface of each of the front assembly half and rear assembly half.

8. The garment hanger of claim 1 wherein the leg member further includes an inclined surface opposing the lower lip, the inclined surface facilitating insertion of the locking tab into the locking slot.

9. The garment hanger of claim 1 wherein the leg member extends in a direction toward the garment engagement surface.

* * * * *